US008316560B2

(12) United States Patent
Caron et al.

(10) Patent No.: US 8,316,560 B2
(45) Date of Patent: Nov. 27, 2012

(54) AIR CUSHIONING OUTSOLE WINDOW

(75) Inventors: Paul E. Caron, Hillsboro, OR (US); Craig K. Sills, Tigard, OR (US)

(73) Assignee: Nike, Inc., Beaverton, OR (US)

( * ) Notice: Subject to any disclaimer, the term of this patent is extended or adjusted under 35 U.S.C. 154(b) by 466 days.

(21) Appl. No.: 12/705,797

(22) Filed: Feb. 15, 2010

(65) Prior Publication Data

US 2011/0197470 A1 Aug. 18, 2011

(51) Int. Cl.
*A43B 13/18* (2006.01)
*A43B 21/26* (2006.01)

(52) U.S. Cl. ..... 36/29; 36/25 R; 36/30 R

(58) Field of Classification Search ..... 36/25 R, 36/28, 29, 30 R
See application file for complete search history.

(56) References Cited

U.S. PATENT DOCUMENTS

| | | | | | |
|---|---|---|---|---|---|
| 4,817,304 | A | | 4/1989 | Parker et al. | |
| 4,845,863 | A | | 7/1989 | Yung-Mao | |
| 4,970,807 | A | * | 11/1990 | Anderie et al. | 36/28 |
| 4,972,611 | A | | 11/1990 | Swartz et al. | |
| 5,005,300 | A | | 4/1991 | Diaz et al. | |
| 5,152,081 | A | | 10/1992 | Hallenbeck et al. | |
| 5,201,125 | A | * | 4/1993 | Shorten | 36/29 |
| 5,363,570 | A | * | 11/1994 | Allen et al. | 36/28 |
| 5,369,896 | A | * | 12/1994 | Frachey et al. | 36/29 |
| 5,542,195 | A | | 8/1996 | Sessa | |
| 5,595,002 | A | * | 1/1997 | Slepian et al. | 36/27 |
| 5,649,374 | A | * | 7/1997 | Chou | 36/27 |
| 5,775,005 | A | | 7/1998 | McClelland | |
| 5,815,949 | A | | 10/1998 | Sessa | |
| 5,860,226 | A | * | 1/1999 | Graham et al. | 36/28 |
| 6,336,220 | B1 | | 1/2002 | Sacks et al. | |
| 7,155,843 | B2 | | 1/2007 | Meschan | |
| 7,213,354 | B1 | | 5/2007 | Byrd et al. | |
| 7,380,353 | B2 | * | 6/2008 | Feller et al. | 36/76 R |
| 7,562,469 | B2 | | 7/2009 | Dojan | |
| 7,757,411 | B2 | * | 7/2010 | Nakano | 36/37 |
| 2007/0017122 | A1 | * | 1/2007 | Feller et al. | 36/35 R |

* cited by examiner

*Primary Examiner* — Marie Patterson
(74) *Attorney, Agent, or Firm* — Harness, Dickey & Pierce, PLC

(57) ABSTRACT

A sole structure for an article of footwear is provided and includes an insole and an outsole. The outsole includes a ground-contacting surface and an inner surface formed on an opposite side of the outsole from the ground-contacting surface. The outsole further includes a first elongated aperture extending through the outsole and between the ground-contacting surface and the inner surface. A midsole is disposed between the insole and the outsole and includes a second elongated aperture at least partially aligned with the first elongated aperture. A window is disposed between the midsole and the outsole and extends over the first elongated aperture and the second elongated aperture. A bladder is disposed between the insole and the midsole and is visible through the window.

29 Claims, 8 Drawing Sheets

AIR CUSHIONING OUTSOLE WINDOW

FIELD

The present disclosure relates to an article of footwear and more particularly to an article of footwear including an air cushioning outsole window.

BACKGROUND

This section provides background information related to the present disclosure which is not necessarily prior art.

Conventional footwear typically includes an upper structure and a sole structure that cooperate to support a foot during use. The upper structure securely receives and positions the foot while the sole structure, which is typically secured to a lower portion of the upper structure and generally between the foot and a ground surface, attenuates reaction forces by absorbing energy as the footwear contacts the ground.

In addition to positioning a foot and absorbing energy during use, modern articles of footwear also concurrently provide a user with comfort, style, and enhanced athletic performance. For example, in one configuration, athletic footwear may provide an athlete with support and comfort during use while concurrently enhancing the athlete's traction and agility. Such a balance between function (i.e., support and comfort) and performance is often achieved through the materials and construction of the sole structure.

The sole structure may include a bladder that contains a fluid such as a gas or gel that provides improved cushioning and shock attenuation to the sole structure. The weight of the wearer and other loading on the bladder causes the fluid to displace within the bladder. As such, the bladder can more easily resiliently deform and/or more easily conform to the wearer's foot than some sole structures made entirely out of foam and rubber.

Bladders are often disposed between layers of the sole structure and, as such, are often blocked from view. Therefore, the wearer may not be aware that the footwear includes a bladder. In some cases, the sole structure includes an opening visually exposing the bladder. However, the opening is typically small, such that only a small portion of the bladder can be viewed, leaving the wearer unable to determine if the bladder is confined to the areas immediately adjacent to the opening or if the bladder extends into other portions of the sole structure. Furthermore, such openings often render the bladder vulnerable to damage from foreign objects.

SUMMARY

This section provides a general summary of the disclosure, and is not a comprehensive disclosure of its full scope or all of its features.

A sole structure for an article of footwear is provided and includes an insole and an outsole. The outsole includes a ground-contacting surface and an inner surface formed on an opposite side of the outsole from the ground-contacting surface. The outsole further includes a first elongated aperture extending through the outsole and between the ground-contacting surface and the inner surface. A midsole is disposed between the insole and the outsole and includes a second elongated aperture at least partially aligned with the first elongated aperture. A window is disposed between the midsole and the outsole and extends over the first elongated aperture and the second elongated aperture. A bladder is disposed between the insole and the midsole and is visible through the window.

An article of footwear is provided and includes an upper structure and a sole structure. The sole structure includes an insole, a midsole, and an outsole. The outsole includes a ground-contacting surface and an inner surface formed on an opposite side of the outsole from the ground-contacting surface. The outsole further includes a first elongated aperture extending through the outsole and between the ground-contacting surface and the inner surface. The midsole is disposed between the insole and the outsole and includes a second elongated aperture at least partially aligned with the first elongated aperture. A window is disposed between the midsole and the outsole and extends over the first elongated aperture and the second elongated aperture. A bladder is disposed between the insole and the midsole and is visible through the window.

An article of footwear is provided and includes an upper structure and a sole structure. The sole structure includes an insole and an outsole. The outsole includes a ground-contacting surface and an inner surface formed on an opposite side of the outsole from the ground-contacting surface. The outsole further includes a first elongated aperture extending through the outsole and between the ground-contacting surface and the inner surface. A window extends over the first elongated aperture and is recessed from the ground-contacting surface. A bladder is disposed between the insole and the outsole, is spaced apart and separated from the window, and is visible through the window.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
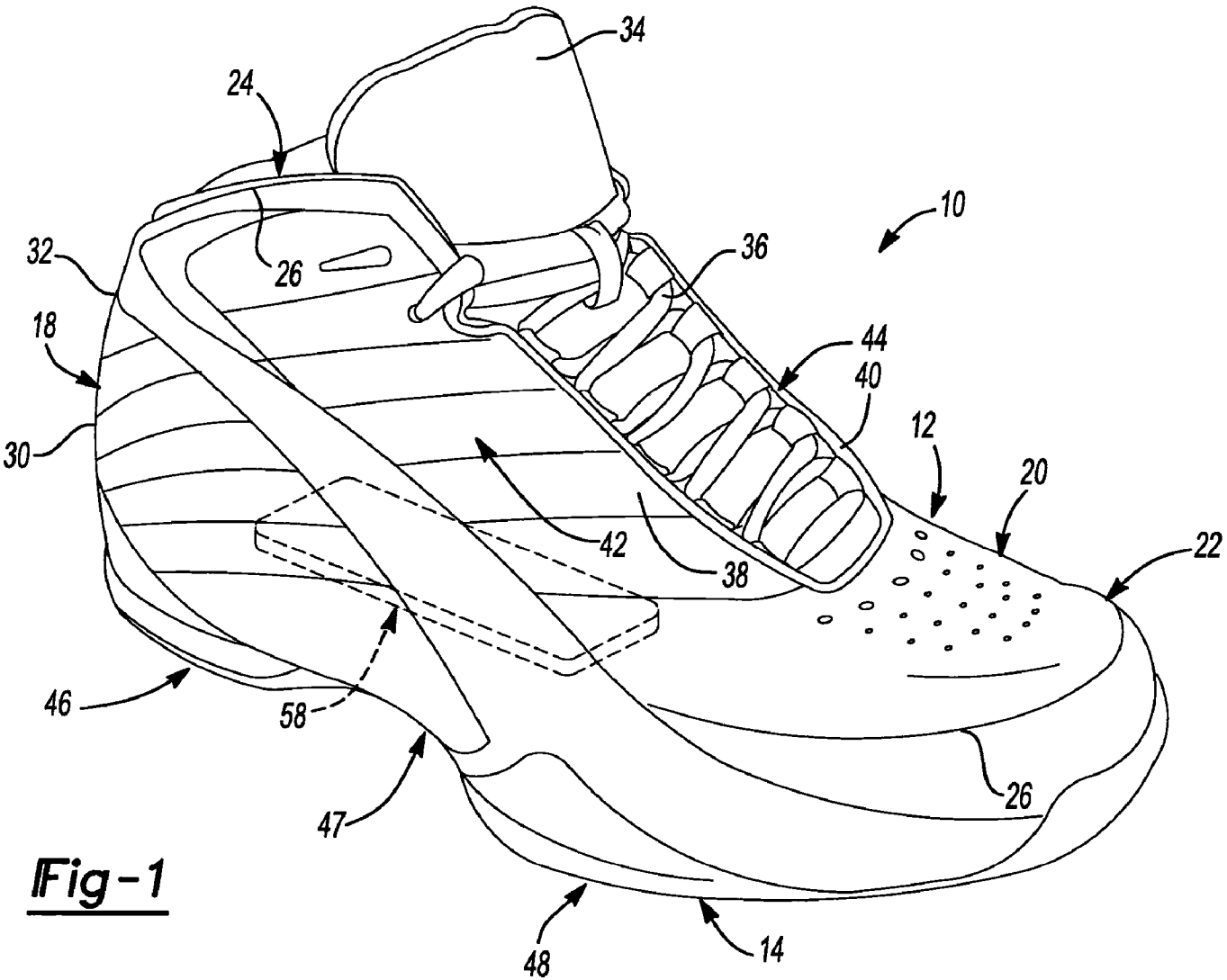
FIG. 1 is a perspective view of an article of footwear according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components and devices, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, elements, and/or components, but do not preclude the presence or addition of one or more other features, integers, elements, components, and/or groups thereof.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-6, an article of footwear 10 is provided and includes an upper structure 12 that selectively receives a user's foot and a sole structure 14 providing support and cushioning to the user's foot during use.

The upper structure 12 includes a rear 18, a vamp 20, a toe box 22, and a liner 24, which are joined together through stitching 26, high-frequency welding, and/or via an epoxy. The upper structure 12 is fastened to the sole structure 14 for securely retaining the user's foot and may be formed of a material that concurrently protects the foot and provides ventilation for cooling and removing perspiration.

The rear 18, or back portion of the article of footwear 10, protects the user's calcaneus or heel bone and minimizes relative movement between the foot and the article of footwear 10 during use. To this end, the rear 18 may include a heel counter 30 providing stiffening properties for the rear of the article of footwear 10 and a topline 32 for bringing the rear 18 into contact with the foot.

The vamp 20 generally covers the instep and toes of the foot and further includes a tongue 34 and laces 36. The vamp 20 is typically separated into a medial portion 38 and a lateral portion 40, which correspond to the medial and lateral sides 42, 44 of the article of footwear 10. The tongue 34 is disposed generally between the medial and lateral portions 38, 40 and may be formed from the same or different material as the medial portion 38 and lateral portion 40. The tongue 34 improves the overall aesthetics of the article of footwear 10 and protects a top portion of the foot by preventing the laces 36 from rubbing against the top portion of the foot. The laces 36 draw the medial and lateral portions 38, 40 of the vamp 20 towards one another for securing the vamp 20 around the foot. The vamp 20 may be made from one or more of a variety of materials such as leather and synthetic materials, which are strategically placed for both functional and aesthetic purposes.

The toe box 22 covers and protects the front portion of the foot and may be formed from a relatively durable material to protect the upper structure 12 from scuffing and to protect the front portion of the foot during use.

The liner 24 is disposed generally within an interior portion of the article of footwear 10 and is positioned such that when the foot is received within the article of footwear 10, the liner 24 is in direct contact with portions of the foot. The liner 24 is formed from a generally soft material formed over a layer of cushioning material to provide the foot with a degree of comfort while also protecting the foot during use.

The sole structure 14 includes a heel portion 46, an arch portion 47, and a forefoot portion 48. The heel portion 46 includes a rear portion of the sole structure 14 supporting a user's calcaneus or heel. The arch portion 47 is disposed between the heel portion 46 and the forefoot portion 48 and supports the arch of the user's foot. The width of the arch portion 47 of the sole structure 14 may be narrower than the heel portion 46 and/or the forefoot portion 48. The forefoot portion 48 of the sole structure 14 supports the portion of the user's foot between the arch and the distal tips of the user's toes including the toes and the ball of the foot.

The sole structure 14 may be formed from an insole 50, a fluid-filled bladder 52, a midsole 54, an outsole 56, and a window 58. The insole 50, bladder 52, midsole 54, and outsole 56 cooperate to protect the foot during use, as well as to absorb energy associated with the article of footwear 10 contacting the ground or floor during use. Absorbing energy associated with the article of footwear 10 contacting the ground or floor reduces the amount of force transmitted to the foot during use and, as such, provides the foot with increased comfort and protection. The sole structure 14 may be secured to the upper structure 12 via an adhesive, high-frequency welding, and/or stitching, for example.

Figure 4:
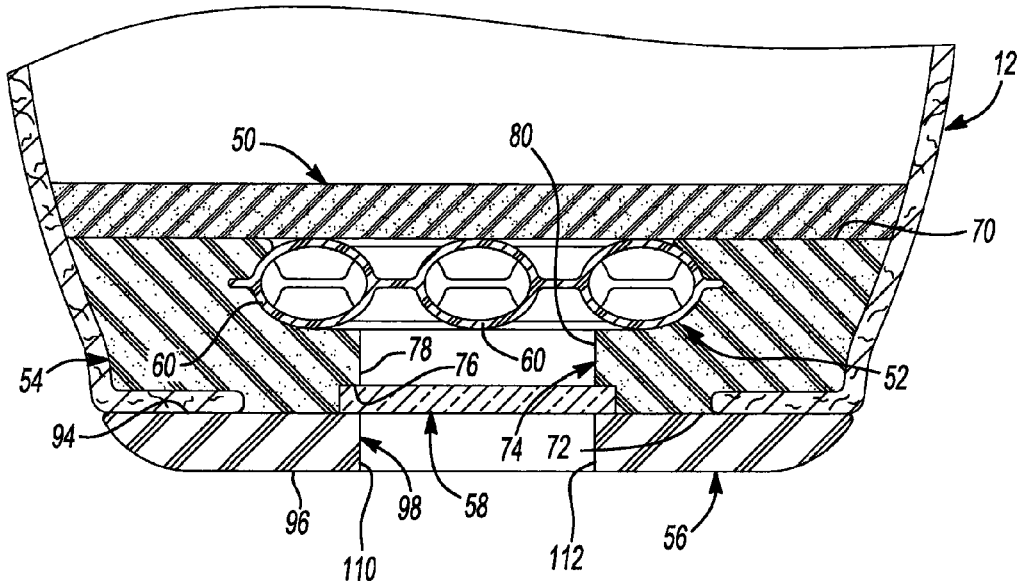
FIG. 4 is a cross-sectional view of the sole structure at line 4-4 of FIG. 2.
Figure 5:
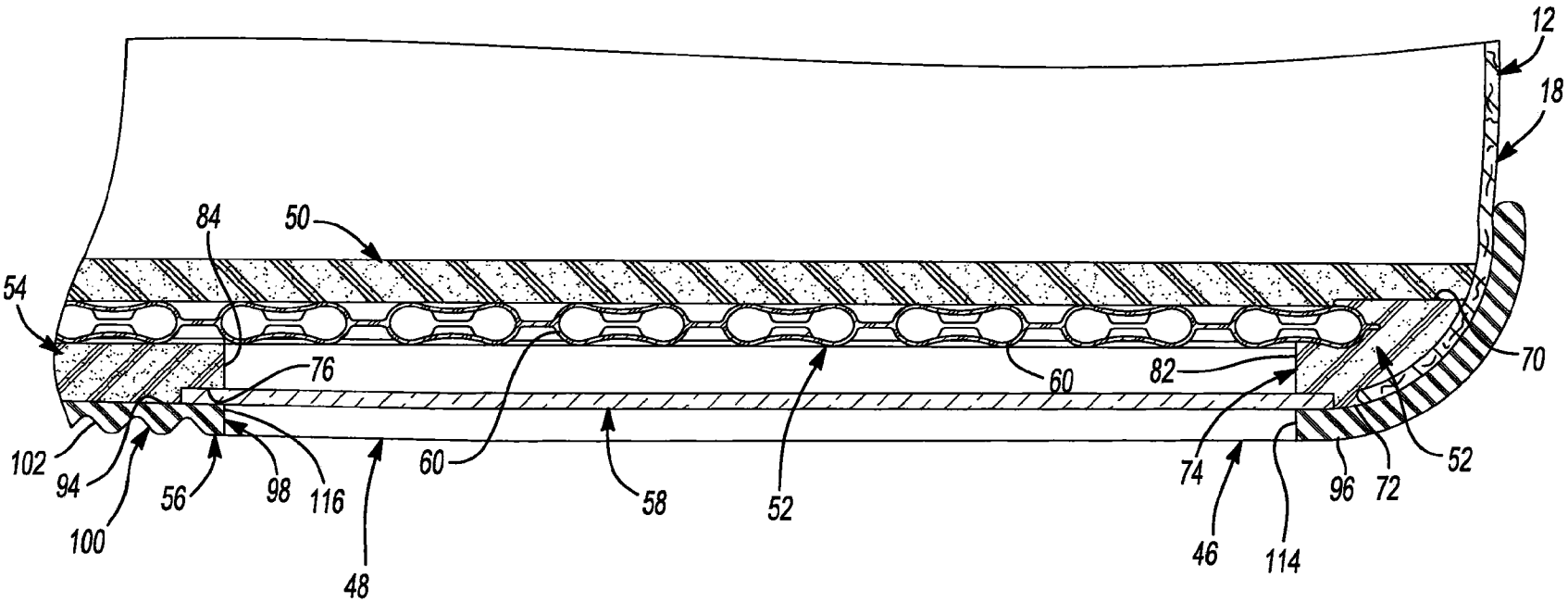
FIG. 5 is a cross-sectional view of the sole structure at line 5-5 of FIG. 2.

The insole 50 is disposed within an interior portion of the article of footwear 10, as shown in FIG. 4, such that the insole 50 is generally surrounded by the upper structure 12. The insole 50 is positioned within the article of footwear 10 such that a bottom portion of the foot is in contact with the insole 50. The insole 50 includes a shape that generally conforms to a shape of a bottom portion of the foot and may include a material that absorbs and otherwise directs moisture away from the foot. The insole 50 may be secured to a strobel material (not shown) of the upper structure 12 via adhesive to prevent removal of the insole 50 from the article of footwear 10. Alternatively, the insole 50 may rest on the strobel material without being adhered to the strobel material to allow removal and/or replacement of the insole 50.

The bladder 52 may be disposed between the insole 50 and the midsole 54 and may extend across one or more of the heel portion 46, the arch portion 47 and/or the forefoot portion 48. In the particular configuration shown in FIG. 3, the bladder 52 extends across the entire sole structure 14 (i.e., from the heel portion 46 to the forefoot portion 48 and from a medial edge to a lateral edge of the sole structure 14). The bladder 52 is formed from a polymeric material and includes one or more pockets 60 inflated with a fluid such as air, nitrogen, or gel, for example, to form a resilient cushioning layer between the user's foot and the ground or floor. The bladder 52 increases the amount of energy that the sole structure 14 is able to absorb, thereby reducing the forces transmitted to the user's foot and enhancing the comfort and protection for the user's foot. The midsole 54, outsole 56, and window 58 cooperate to protect the bladder 52 from damage from foreign objects that may puncture the pockets 60.

Figure 2:
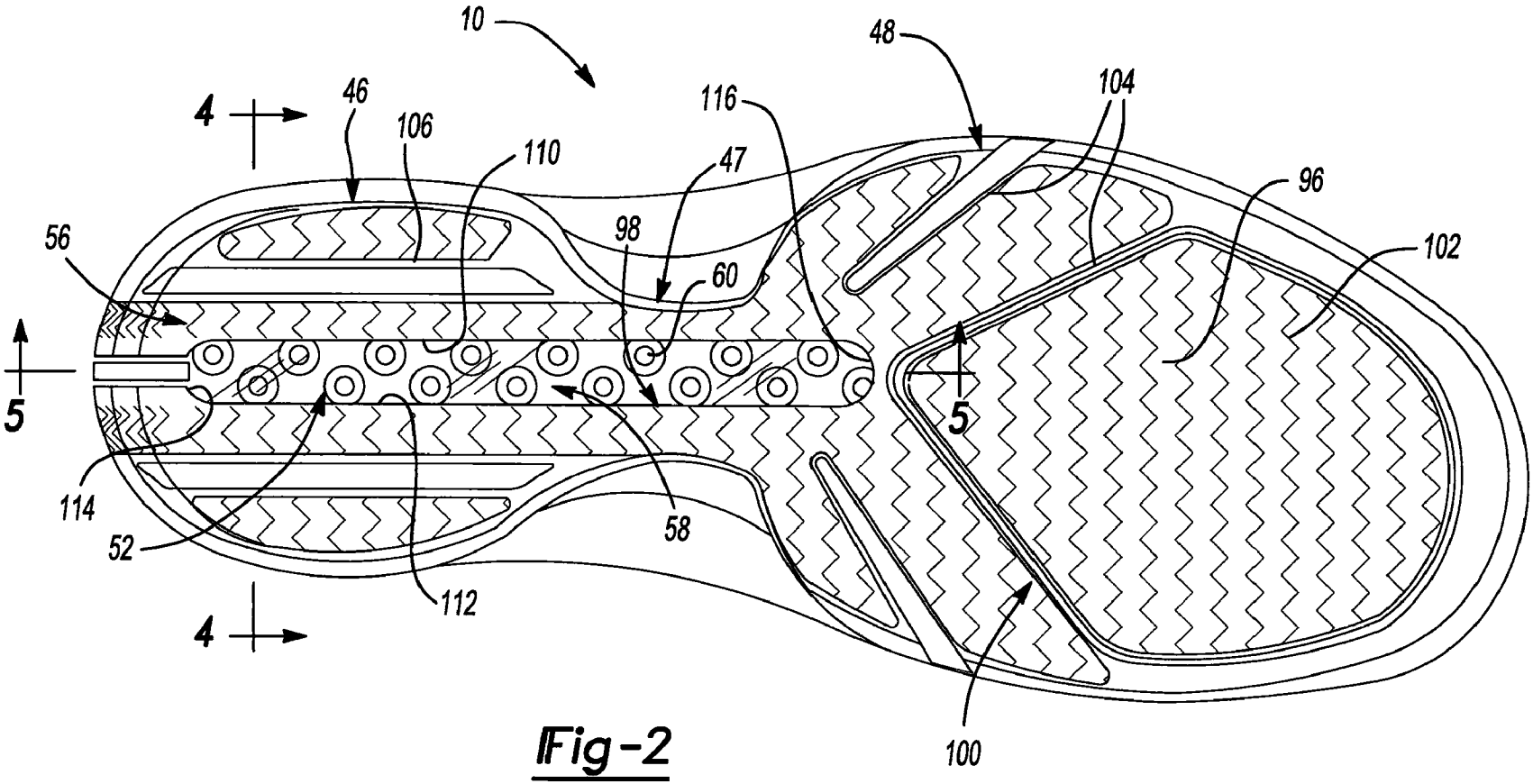
FIG. 2 is a bottom view of the article of footwear of FIG. 1 including a sole structure according to the principles of the present disclosure.
Figure 3:
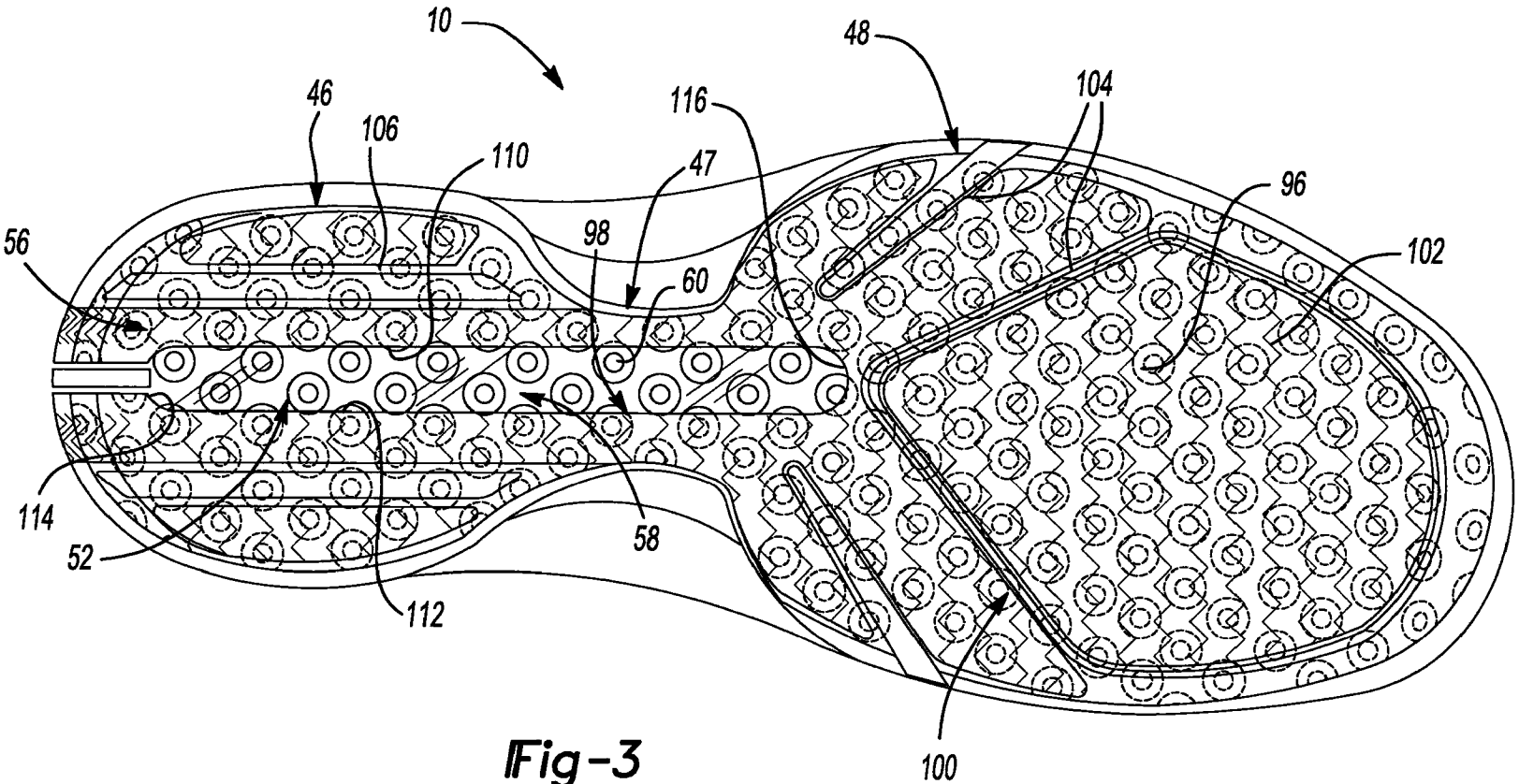
FIG. 3 is a bottom view of the sole structure of FIG. 2 illustrating hidden portions of a fluid-filled bladder.
Figure 6:
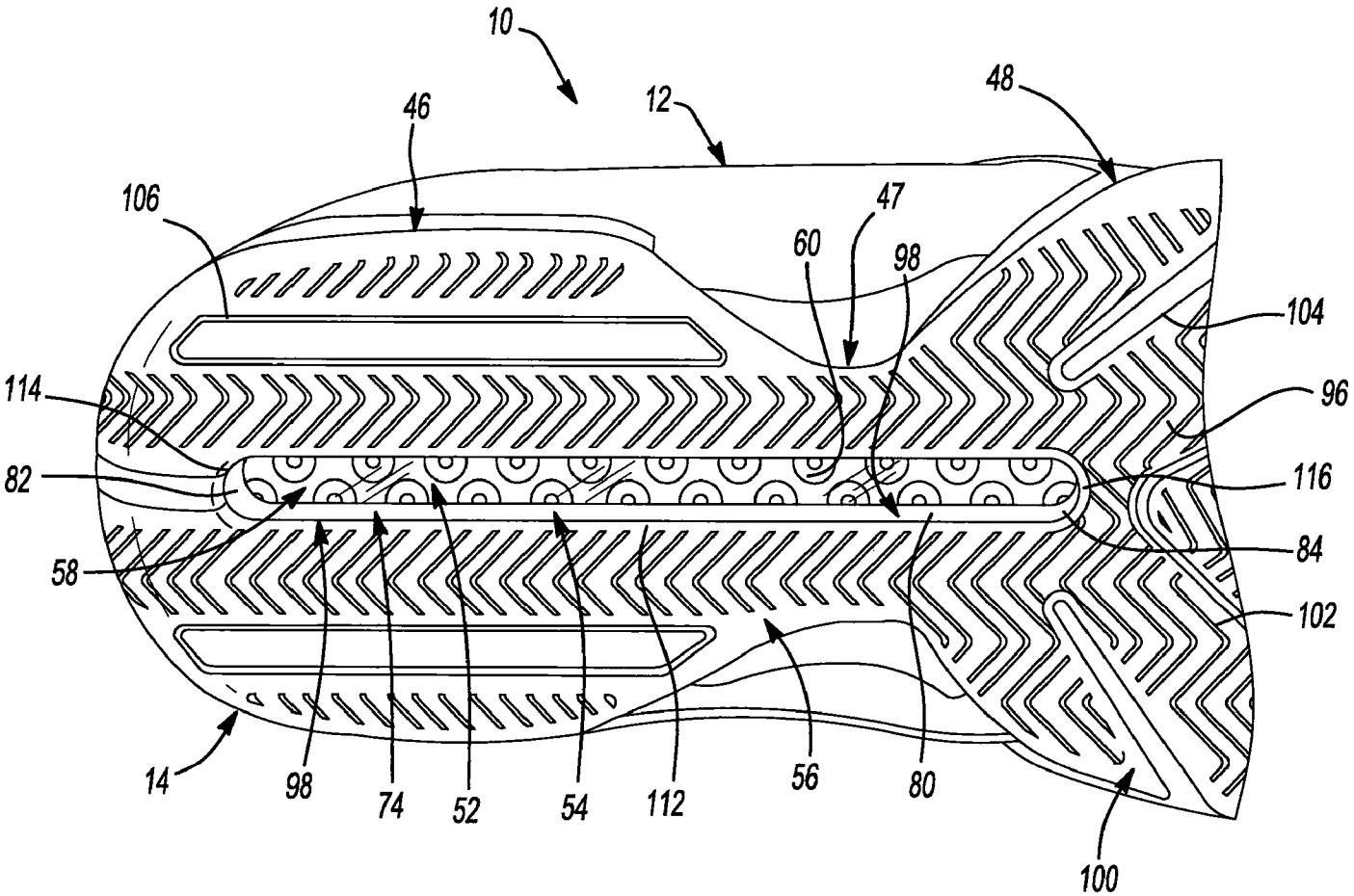
FIG. 6 is a partial perspective view of the sole structure of FIG. 2.
Figure 8:
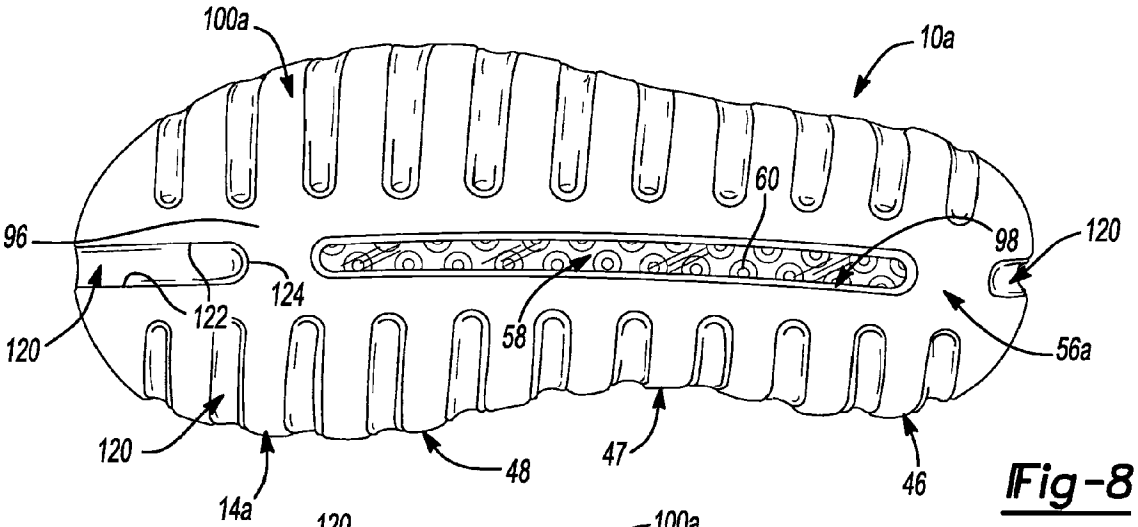
FIG. 8 is a bottom view of the article of footwear of FIG. 7 having a sole structure according to the principles of the present disclosure.
Figure 9:
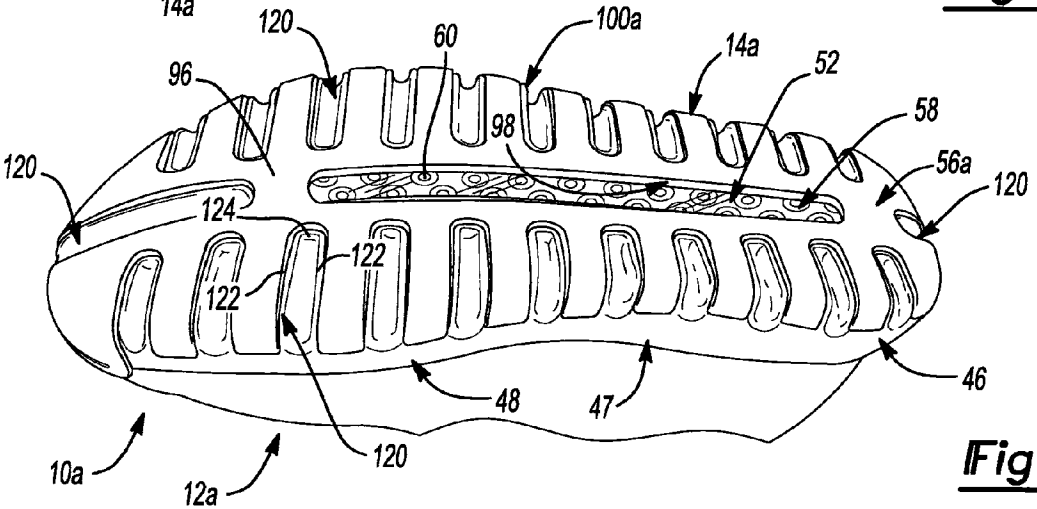
FIG. 9 is a bottom perspective view of the article of footwear of FIG. 7.

In one configuration, the midsole 54 is disposed between the bladder 52 and the outsole 56 and includes an inner surface 70, an outer surface 72, an elongated aperture 74, and a recess 76. The aperture 74 extends through the inner and outer surfaces 70, 72 and includes first and second elongated sides 78, 80 that may be parallel to each other and opposing each other. Both ends of the first and second elongated sides 78, 80 may be connected to each other by first and second opposing arcuate sides 82, 84, respectively. The first and second elongated sides 78, 80 may extend from the heel portion 46 of the sole structure 14 to the forefoot portion 48, as shown in FIGS. 2, 3 and 6. In other configurations, the first and second elongated sides 78, 80 may extend across more or less of the sole structure 14, as shown in FIGS. 8 and 9, for example. While the first and second elongated sides 78, 80 are described above and shown in the Figures as being generally linear and parallel, in some configurations, the first and second elongated sides 78, 80 may be curved, angled, and/or otherwise formed. Additionally or alternatively, while the first and second opposing sides 82, 84 are described above as being arcuate, the first and second opposing sides 82, 84 could be generally linear.

The recess 76 extends inward from the outer surface 72 through a portion of the thickness of the midsole 54 and surrounds a perimeter of the aperture 74. The recess 76 may at least partially receive the window 58, such that the window 58 covers the aperture 74 and is spaced apart from the bladder 52.

The midsole 54 may be molded of a foam material such as thermoplastic polyurethane (TPU). The TPU material provides the article of footwear 10 with a light-weight and durable construction while concurrently providing the foot with support and stability. Due to the relatively light-weight of the TPU material, the midsole 54 may formed to include a relatively large thickness to provide increased protection to the bladder 52. Additionally, the TPU material may also provide the article of footwear 10 with a stylish appearance, as the TPU material readily accepts various dyes and, as such, can be formed in virtually any color and incorporate a variety of aesthetic designs. Depending upon the particular requirements for the article of footwear 10, however, the midsole 54 may be molded from a variety of alternate materials, such as ethylene vinyl acetate (EVA), rubber, or injection pylon.

As described above, the TPU material provides the article of footwear 10 with a lightweight construction. While conventional footwear incorporates a similarly constructed polyurethane material (PU), the TPU material is a lighter-weight material in comparison and, as such, may be especially suited for use in an article of footwear that is intended for athletic and/or fitness applications. As such, the midsole 54 of the article of footwear 10 is formed from a TPU material to provide the midsole 54 with support and stability while concurrently maintaining the weight of the midsole 54 within a predetermined range suitable for an article of footwear intended for such use.

The outsole 56 includes an inner surface 94, an outer surface 96*a*, and an elongated aperture 98 and may be formed from a non-marking synthetic rubber blend or other resilient polymeric material that provides the outsole 56 with traction and durability. The inner surface 94 may be adhesively bonded to the outer surface 72 of the midsole 54 and may be high-frequency welded, stitched, and/or adhesively bonded to the upper structure 12.

The outer surface 96*a* includes a tread pattern 100 (FIGS. 2 and 6) that provides grip between the user's foot and the ground or floor. The tread pattern 100 may be designed in any suitable manner to improve traction and/or aesthetic qualities of the article of footwear 10. The tread pattern 100 may be tailored for a particular purpose, activity and/or sport for which the article of footwear 10 is intended. For example, in the particular configuration illustrated in FIGS. 2 and 6, the tread pattern 100 includes a plurality of serpentine grooves 102, a plurality of transverse grooves 104 disposed in the forefoot portion 48 of the sole structure 14, and a plurality of generally polygonal grooves 106 disposed in the heel portion 46 of the sole structure 14. This particular configuration may be especially well-suited for athletic activities such as basketball, for example. In other configurations, the outer surface 96*a* may include spikes or cleats, which may be especially well-suited for athletic activities played on turf, dirt or other relatively soft surfaces.

The aperture 98 extends through the inner surface 94 and the outer surface 96*a* of the outsole 56 and includes first and second elongated sides 110, 112 that may be parallel to each other and opposing each other. Both ends of the first and second elongated sides 110, 112 may be connected to each other by first and second opposing arcuate sides 114, 116, respectively. The first and second elongated sides 110, 112 and the first and second opposing arcuate sides 114, 116 may be substantially aligned with the first and second elongated sides 78, 80 and the first and second opposing arcuate sides 82, 84, respectively, of the aperture 74 extending through the midsole 54.

The first and second elongated sides 110, 112 may extend from the heel portion 46 of the sole structure 14 to a forefoot portion 48, as shown in FIGS. 2 and 6. In other configurations, the first and second elongated sides 110, 112 may extend across more or less of the sole structure 14, as shown in FIGS. 8 and 9, for example. While the first and second elongated sides 110, 112 are described above and shown in the Figures as being generally linear and parallel, in some configurations, the first and second elongated sides 110, 112 may be curved, angled, and/or otherwise formed. Additionally or alternatively, while the first and second opposing sides 114, 116 are described above as being arcuate, the first and second opposing sides 114, 116 could be generally linear.

The window 58 is a sheet of transparent or translucent polymeric material that may be substantially aligned with the apertures 74, 98 of the midsole 54 and the outsole 56, respectively, to allow the bladder 52 to be viewed while concurrently protecting the bladder 52 from damage. In some configurations, the window 58 may include lettering, logos, and/or graphics. The window 58 may be received in the recess 76 of the midsole 54 and may be adhesively bonded or otherwise secured to the inner surface 94 of the outsole 56 and/or the midsole 54. In this manner, the window 58 may be spaced apart from the bladder 52 to provide an air gap between the bladder 52 and the window 58, which provides further protection for the bladder 52. The polymeric material from which the window 58 is formed may be sufficiently durable to resist or prevent being punctured by foreign objects during use. Because the window 58 is disposed between midsole 54 and the inner surface 94 of the outsole 56, the window 58 is spaced apart from the outer surface 96*a* of the outsole 56. Spacing the window 58 from the outer surface 96*a* of the outsole 56 protects the window 58 from abrasive wear due to contact with the ground or floor.

Figure 7:
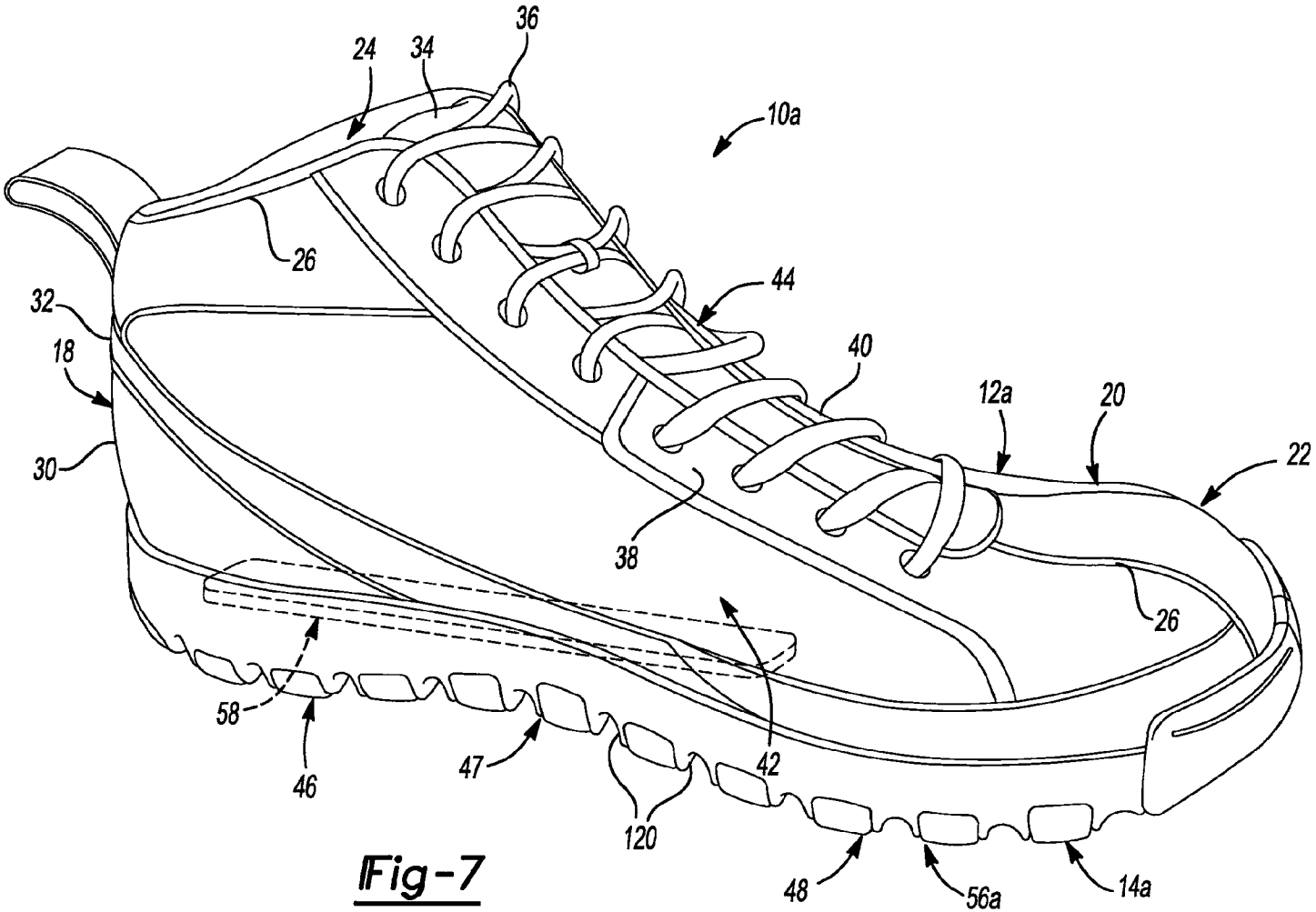
FIG. 7 is a perspective view of another configuration of an article of footwear according the principles of the present disclosure.

Referring now to FIGS. 7-9, an article of footwear 10*a* is provided. In view of the substantial similarity in structure and function of the components associated with the article of footwear 10*a* with respect to the article of footwear 10, like reference numerals are used hereinafter in the drawings to identify like components while like reference numerals containing letter extensions are used to identify those components that have been modified.

The article of footwear 10*a* includes an upper structure 12*a* and a sole structure 14*a* fixed to a bottom portion of the upper structure 12*a*. While the upper structure 12*a* of the article of footwear 10*a* may differ in overall shape and appearance, the structure and function of the upper structure 12*a* of the article of footwear 10*a* is substantially similar to the upper structure 12 of the article of footwear 10. As such, the upper structure 12*a* will not be described further.

The sole structure 14*a* may include the insole 50, the bladder 52, the midsole 54, and the window 58 described above with reference to the article of footwear 10, as well as an outsole 56*a*. As described above, the insole 50, the bladder 52, the midsole 54, and the outsole 56*a* cooperate to protect the user's foot during use, as well as to absorb energy associated with the article of footwear 10*a* contacting the ground or floor during use. The sole structure 14*a* may be secured to the upper structure 12*a* via an adhesive, high-frequency welding, and/or stitching, for example.

The outsole 56*a* includes the inner surface 94, an outer surface 96*a*, and the aperture 98 described above and may be formed from a non-marking synthetic rubber blend or other resilient polymeric material that provides the outsole 56*a* with traction and durability. As described above, the inner surface 94 may be adhesively bonded to the outer surface 72 of the midsole 54 (FIG. 4) and may be high-frequency welded, stitched, and/or adhesively bonded to the upper structure 12*a*.

The outer surface 96*a* includes a tread pattern 100*a* that provides grip between the user's foot and the ground or floor. The tread pattern 100*a* may be designed in any suitable manner to improve traction and/or aesthetic qualities of the article of footwear 10. The tread pattern 100*a* may be tailored for a particular purpose, activity and/or sport for which the article of footwear 10*a* is intended. For example, in the particular configuration illustrated in FIGS. 8 and 9, the tread pattern 100*a* includes a plurality of channels 120. The channels 120 may include opposing elongated sides 122 extending inward from an outer edge of the outsole 56*a* and forming generally U-shaped cross-sections. The opposing elongated sides 122 may be connected to each other by an arcuate side 124. One or more of the channels 120 may extend generally perpendicular or at an angle relative to the apertures 74, 98 of the midsole 54 and the outsole 56*a*, respectively, while another one or more of the channels 120 may be parallel or longitudinally aligned with the apertures 74, 98.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A sole structure for an article of footwear comprising:

an insole;

an outsole including a ground-contacting surface and an inner surface formed on an opposite side of said outsole from said ground-contacting surface, said outsole including a first elongated aperture extending through said outsole and between said ground-contacting surface and said inner surface;

a midsole disposed between said insole and said outsole and including a second elongated aperture at least partially aligned with said first elongated aperture;

a window disposed between said midsole and said outsole and extending over said first elongated aperture and said second elongated aperture; and a bladder disposed between said insole and said midsole, said bladder being visible through said window.

2. The sole structure according to claim 1, wherein said window extends completely over said first elongated aperture.

3. The sole structure according to claim 1, wherein said outsole includes a heel portion, an arch portion, and a forefoot portion, said first elongated aperture extending between said heel portion and said arch portion.

4. The sole structure according to claim 1, wherein said outsole includes a heel portion, an arch portion, and a forefoot portion, said first elongated aperture extending from said heel portion to said forefoot portion.

5. The sole structure according to claim 1, wherein said window is spaced apart from said bladder.

6. The sole structure according to claim 1, wherein said window is recessed from said ground-contacting surface of said outsole.

7. The sole structure according to claim 1, wherein said first elongated aperture includes first and second elongated opposing sides connected by first and second opposing arcuate sides.

8. The sole structure according to claim 1, wherein said window is formed from a polymeric material.

9. The sole structure according to claim 1, wherein said window is formed from at least one of a transparent polymeric material and a translucent polymeric material.

10. The sole structure according to claim 1, wherein said bladder is an air bladder.

11. An article of footwear comprising:

an upper structure; and a sole structure, said sole structure comprising:

an insole;

an outsole including a ground-contacting surface and an inner surface formed on an opposite side of said outsole from said ground-contacting surface, said outsole including a first elongated aperture extending through said outsole and between said ground-contacting surface and said inner surface;

a midsole disposed between said insole and said outsole and including a second elongated aperture at least partially aligned with said first elongated aperture;

a window disposed between said midsole and said outsole and extending over said first elongated aperture and said second elongated aperture; and a bladder disposed between said insole and said midsole, said bladder being visible through said window.

12. The article of footwear according to claim 11, wherein said window extends completely over said first elongated aperture.

13. The article of footwear according to claim 11, wherein said outsole includes a heel portion, an arch portion, and a forefoot portion, said first elongated aperture extending between said heel portion and said arch portion.

14. The article of footwear according to claim 11, wherein said outsole includes a heel portion, an arch portion, and a forefoot portion, said first elongated aperture extending from said heel portion to said forefoot portion.

15. The article of footwear according to claim 11, wherein said window is spaced apart from said bladder.

16. The article of footwear according to claim 11, wherein said window is recessed from said ground-contacting surface of said outsole.

17. The article of footwear according to claim 11, wherein said first elongated aperture includes first and second elongated opposing sides connected by first and second opposing arcuate sides.

18. The article of footwear according to claim 11, wherein said window is formed from a polymeric material.

19. The article of footwear according to claim 11, wherein said window is formed from at least one of a transparent polymeric material and a translucent polymeric material.

20. The article of footwear according to claim 11, wherein said bladder is an air bladder.

21. An article of footwear comprising:

an upper structure; and a sole structure, said sole structure comprising:

an insole;

an outsole including a ground-contacting surface and an inner surface formed on an opposite side of said outsole from said ground-contacting surface, said outsole including a first elongated aperture extending through said outsole and between said ground-contacting surface and said inner surface;

a window extending over said first elongated aperture and recessed from said ground-contacting surface; and a bladder disposed between said insole and said outsole, spaced apart and separated from said window, and being visible through said window.

22. The article of footwear according to claim 21, wherein said window extends completely over said first elongated aperture.

23. The article of footwear according to claim 21, wherein said outsole includes a heel portion, an arch portion, and a forefoot portion, said first elongated aperture extending between said heel portion and said arch portion.

24. The article of footwear according to claim 21, wherein said outsole includes a heel portion, an arch portion, and a forefoot portion, said first elongated aperture extending from said heel portion to said forefoot portion.

25. The article of footwear according to claim 21, further comprising a midsole disposed between said insole and said outsole.

26. The article of footwear according to claim 21, wherein said first elongated aperture includes first and second elongated opposing sides connected by first and second opposing arcuate sides.

27. The article of footwear according to claim 21, wherein said window is formed from a polymeric material.

28. The article of footwear according to claim 21, wherein said window is formed from at least one of a transparent polymeric material and a translucent polymeric material.

29. The article of footwear according to claim 21, wherein said bladder is an air bladder.

* * * * *